US011172555B2

(12) United States Patent
Yamamoto et al.

(10) Patent No.: US 11,172,555 B2
(45) Date of Patent: Nov. 9, 2021

(54) LIGHT EMITTING APPARATUS AND CHROMATICITY VARIATION CORRECTION METHOD

(71) Applicant: Yazaki Corporation, Tokyo (JP)

(72) Inventors: Shohei Yamamoto, Makinohara (JP); Terumitsu Sugimoto, Makinohara (JP); Moyu Tanaka, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/882,991

(22) Filed: May 26, 2020

(65) Prior Publication Data

US 2020/0413506 A1 Dec. 31, 2020

(30) Foreign Application Priority Data

Jun. 27, 2019 (JP) ..... JP2019-119952

(51) Int. Cl.
*H05B 45/20* (2020.01)
*H05B 45/22* (2020.01)

(52) U.S. Cl.
CPC ..... *H05B 45/22* (2020.01)

(58) Field of Classification Search
CPC ..... H05B 45/20; H05B 45/22; H05B 45/28; H05B 45/37; H05B 45/325; H05B 45/345; H05B 47/18; H05B 45/10; H05B 45/46; H05B 45/30; F21Y 2105/10; F21Y 2115/10; B60Q 3/16; B60Q 3/18; B60Q 3/80; G03G 15/04054; G03G 15/043
See application file for complete search history.

(56) References Cited

U.S. PATENT DOCUMENTS 7,608,862 B2 * 10/2009 Sakuma ..... C09K 11/0883 257/100
7,656,371 B2 * 2/2010 Shimizu ..... H05B 45/28 345/83
7,675,249 B2 * 3/2010 Furukawa ..... G09G 3/3413 315/309
8,339,029 B2 12/2012 Kim et al.
8,569,974 B2 10/2013 Chobot
8,710,750 B2 * 4/2014 Nonaka ..... H05B 45/3725 315/185 S
8,711,444 B2 * 4/2014 Oyama ..... G03G 15/04054 358/475
9,185,753 B2 * 11/2015 Igaki ..... H05B 45/37
(Continued)

FOREIGN PATENT DOCUMENTS

JP 2017-84573 A 5/2017
WO 2010097753 A1 9/2010
WO 2012000386 A1 1/2012

*Primary Examiner* — Haissa Philogene
(74) *Attorney, Agent, or Firm* — Sughrue Mion, PLLC

(57) ABSTRACT

A light emitting apparatus includes a plurality of full-color LED units. Constant current values of the constant current elements are set such that the plurality of full-color LED units come closer to a same chromaticity as compared with a case in which all the constant current elements of all the full-color LED units have a same constant current value. As a result, in at least one of the plurality of full-color LED units, at least one of the plurality of constant current elements is set to a constant current value different from that of the other constant current elements.

4 Claims, 4 Drawing Sheets

(56) References Cited

U.S. PATENT DOCUMENTS

| | | | | |
|---|---|---|---|---|
| 9,985,182 | B2 * | 5/2018 | Watanabe | H01L 33/504 |
| 10,237,935 | B2 * | 3/2019 | Seki | H05B 45/37 |
| 10,555,396 | B1 * | 2/2020 | Sugiura | H05B 47/18 |
| 10,657,868 | B2 * | 5/2020 | Biwa | G09G 3/32 |
| 2007/0171180 | A1 | 7/2007 | Akiyama | |
| 2009/0015759 | A1 | 1/2009 | Honbo | |
| 2013/0241433 | A1 | 9/2013 | Ge et al. | |
| 2017/0118816 | A1 | 4/2017 | Ohashi et al. | |

* cited by examiner

LIGHT EMITTING APPARATUS AND CHROMATICITY VARIATION CORRECTION METHOD

CROSS-REFERENCE TO RELATED APPLICATIONS

This application is based on and claims priority under 35 USC 119 from Japanese Patent Application No. 2019-119952 filed on Jun. 27, 2019, the contents of which are incorporated herein by reference.

TECHNICAL FIELD

The present invention relates to a light emitting apparatus and a chromaticity variation correction method that can be used for illumination of a vehicle or the like.

BACKGROUND ART

For example, in a case of illuminating an interior of a vehicle which is a passenger car or the like, it is desired to illuminate the interior of the vehicle with illumination light of an appropriate chromaticity according to a situation at that time. In this application, it is possible to attain illumination light of various chromaticities as necessary by using, as a light source, a full-color LED unit including a plurality of light emitting elements (light emitting diodes: LEDs) that emit light at wavelengths of colors of red (R), green (G), and blue (B).

However, the LEDs have a luminous intensity and wavelength difference for each individual, so that chromaticity variation occurs for each full-color LED even if the same drive waveform is applied. The chromaticity variation is particularly noticeable when a plurality of full-color LEDs are arranged side by side, and has been regarded as a problem of vehicle interior quality.

Therefore, it has been proposed to correct the chromaticity variation by correcting duty of the drive waveform applied to the LED (Patent Literature 1).

CITATION LIST

Patent Literature

Patent Literature 1: JP-A-2017-84573

SUMMARY OF INVENTION

However, in the above-described related art, it is necessary to change software of an LED control unit that outputs the drive waveform to provide a function of correcting the chromaticity variation. It is necessary to change software for each full-color LED unit, and there is a problem in terms of cost as the number of LED control units increases or the like.

The present invention has been made in view of the above-described circumstances. An aspect of the present invention provides a light emitting apparatus and a chromaticity variation correction method that are capable of preventing chromaticity variation at low cost.

In order to achieve the above-described aspect, the light emitting apparatus and the chromaticity variation correction method according to the present invention are characterized by the following [1] to [5].

[1] A light emitting apparatus including:

a plurality of light emitting units including a light source that includes a plurality of light emitters having different emission colors, and constant current elements that are provided corresponding to the plurality of light emitters respectively and are configured to supply a constant current to the corresponding light emitters to cause the light emitters to emit light, in which, in at least one of the plurality of light emitting units, at least one of the plurality of constant current elements is set to a constant current value different from that of the other constant current elements.

[2] The light emitting apparatus according to [1], in which constant current values of the constant current elements are set such that the plurality of light emitting units come closer to a same chromaticity as compared with a case in winch all the constant current elements of all the fight emitting units have a same constant current value.

[3] The light emitting apparatus according to [2], in which the plurality of light emitters emit red, blue, and green light, respectively, and in which the constant current values of the constant current elements are set such that the plurality of light emitting units come close to white.

[4] A chromaticity variation correction method for correcting chromaticity variation of a plurality of light emitting units each including a light source that includes a plurality of light emitters having different emission colors, and constant current elements that are provided corresponding to the plurality of light emitters respectively and are configured to supply a constant current to the corresponding light emitters to cause the light emitters to emit light, the chromaticity variation correction method including:

adjusting constant current values of the constant current elements to correct chromaticity variation of the plurality of light emitting units.

[5] The chromaticity variation correction method according to [4], further including:

setting all the constant current elements of all the light emitting units to a same constant current value and measuring chromaticities of all the light emitting units when a same control signal is supplied to all the light emitting units; and adjusting the constant current value of the constant current elements based on the measured chromaticities.

According to the light emitting apparatus and the chromaticity variation correction method in [1] to [5], it is possible to prevent the chromaticity variation of each light emitting unit by adjusting the constant current value of the constant current element without adjusting the control signal.

According to the present invention, it is possible to provide a light emitting unit, a light emitting apparatus, and a chromaticity variation correction method that are capable of preventing chromaticity variation at low cost.

The present invention has been briefly described as above. Details of the present invention will be further clarified by reading a mode (hereinafter, referred to as an "embodiment") for carrying out the present invention described below with reference to the accompanying drawings.

DESCRIPTION OF EMBODIMENTS

A specific embodiment of the present invention will be described below with reference to the drawings.

Figure 1:
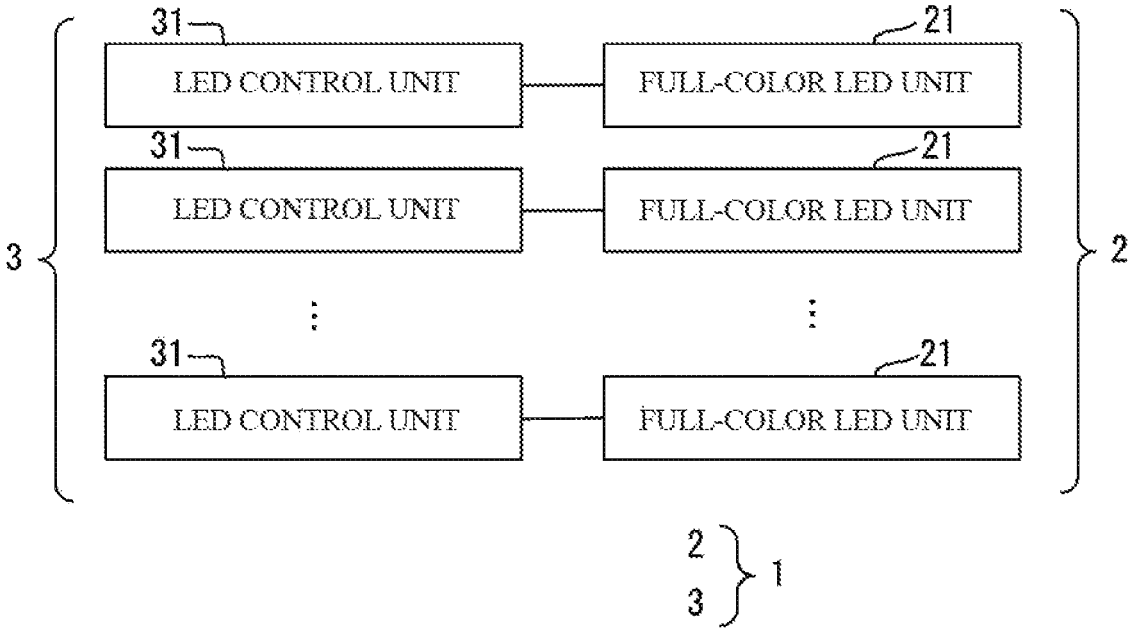
FIG. 1 is a block diagram showing a vehicle illumination apparatus including a full-color LED unit as a light emitting unit according to an embodiment of the present invention.

As shown in FIG. 1, the vehicle illumination apparatus 1 is configured to illuminate an interior of a vehicle, and includes a light emitting apparatus 2 and a control device 3 configured to control turning on and off the light emitting apparatus 2. The light emitting apparatus includes a plurality of full-color LED units 21 (light emitting units).

Figure 2:
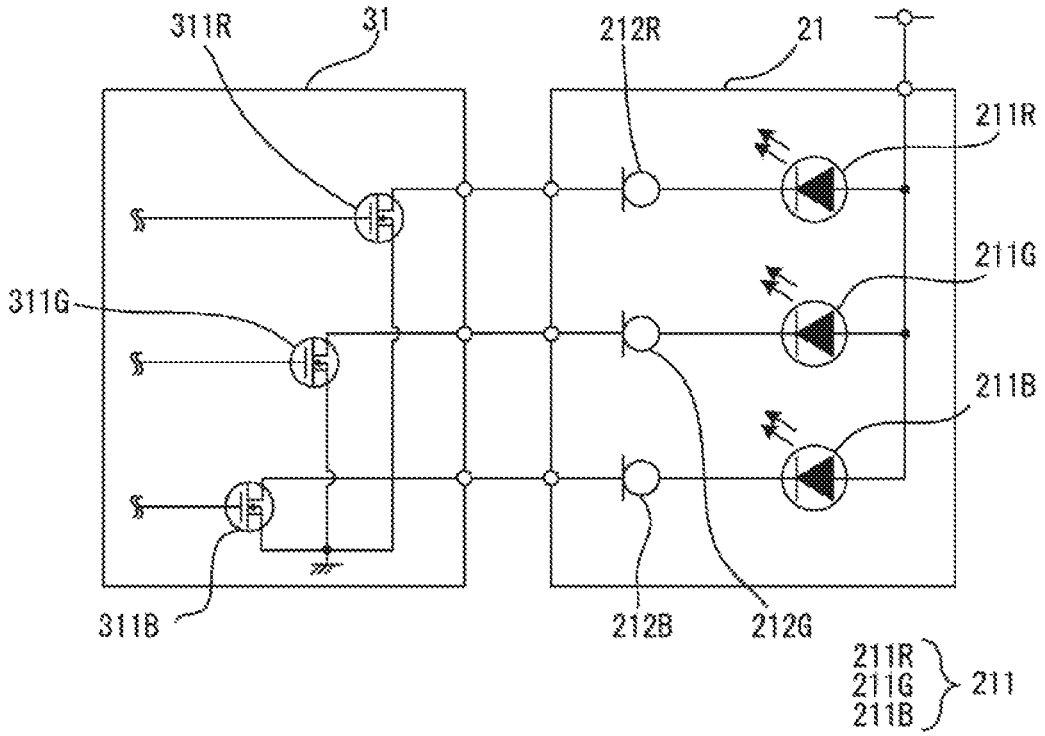
FIG. 2 is a circuit diagram showing details of the full-color LED unit shown in FIG. 1.

As shown in FIG. 2, the full-color LED unit 21 includes a full-color LED 211 (a light source) and constant current elements 212R, 212G, 212B. The full-color LED 211 includes three light emitting diodes (LEDs) 211R, 211G, 211B configured to emit light at wavelengths of colors of red (R), green (G), and blue (B).

The constant current elements 212R, 212G, 212B are provided corresponding to the three LEDs 211R, 211G, 211B (the light emitters), respectively, and are configured to supply a constant current to the corresponding LEDs 211R, 211G, 211B to cause the LEDs 211R, 211G, 211B to emit light. Anodes of the three LEDs 211R, 211G, 211B are each connected to a power supply. The constant current elements 212R, 212G, 212B are connected in series to the corresponding LEDs 211R, 211G, 211B.

The control device 3 includes a plurality of LED control units 31. The LED control unit 31 includes three FETs 311R, 311G, 311B provided corresponding to the three LEDs 211R, 211G, 211B, respectively. Sources of the three FETs 311R, 311G, 311B are connected to one another, and drains of the three FETs 311R, 311G, 311B are connected to the constant current elements 212R, 212G, 212B configured to supply a constant current to the corresponding LEDs 211R, 211G, 211B.

Accordingly, when the FETs 311R, 311G, 311B are turned on, a constant current is supplied to the LEDs 211R, 211G, 211B, and the LEDs 211R, 211G, 211B are turned on. On the other hand, when the FETS 311R, 311G, 311B are turned off, the supply of the constant current to the LEDs 211R, 211G, 211B is cut off, and the LEDs 211R, 211G, 211B are turned off. A pulse control signal is supplied from an ECU (not shown) to gates of the LEDs 211R, 211G, 211B, and on and off of the LEDs 211R, 211G, 211B is controlled by the control signal.

Next, a chromaticity variation correction method for correcting chromaticity variation of the plurality of full-color LED units 21 described above will be described with reference to FIGS. 3 and 4. Here, in order to simplify the description, a method for correcting chromaticity variation of the three full-color LED units 21 will be described. The chromaticity variation correction method is performed before shipment of the vehicle illumination apparatus 1.

First, all the constant current elements 212R, 212G, 212B provided in all the full-color LED units 21 are set to have the same constant current value. Then, the same control signal is input to the LEDs 211R, 211G, 211B provided in all the full-color LED units 21. Next, a chromaticity of all the full-color LED units 21 is measured by a chromaticity sensor (not shown).

Figure 3:
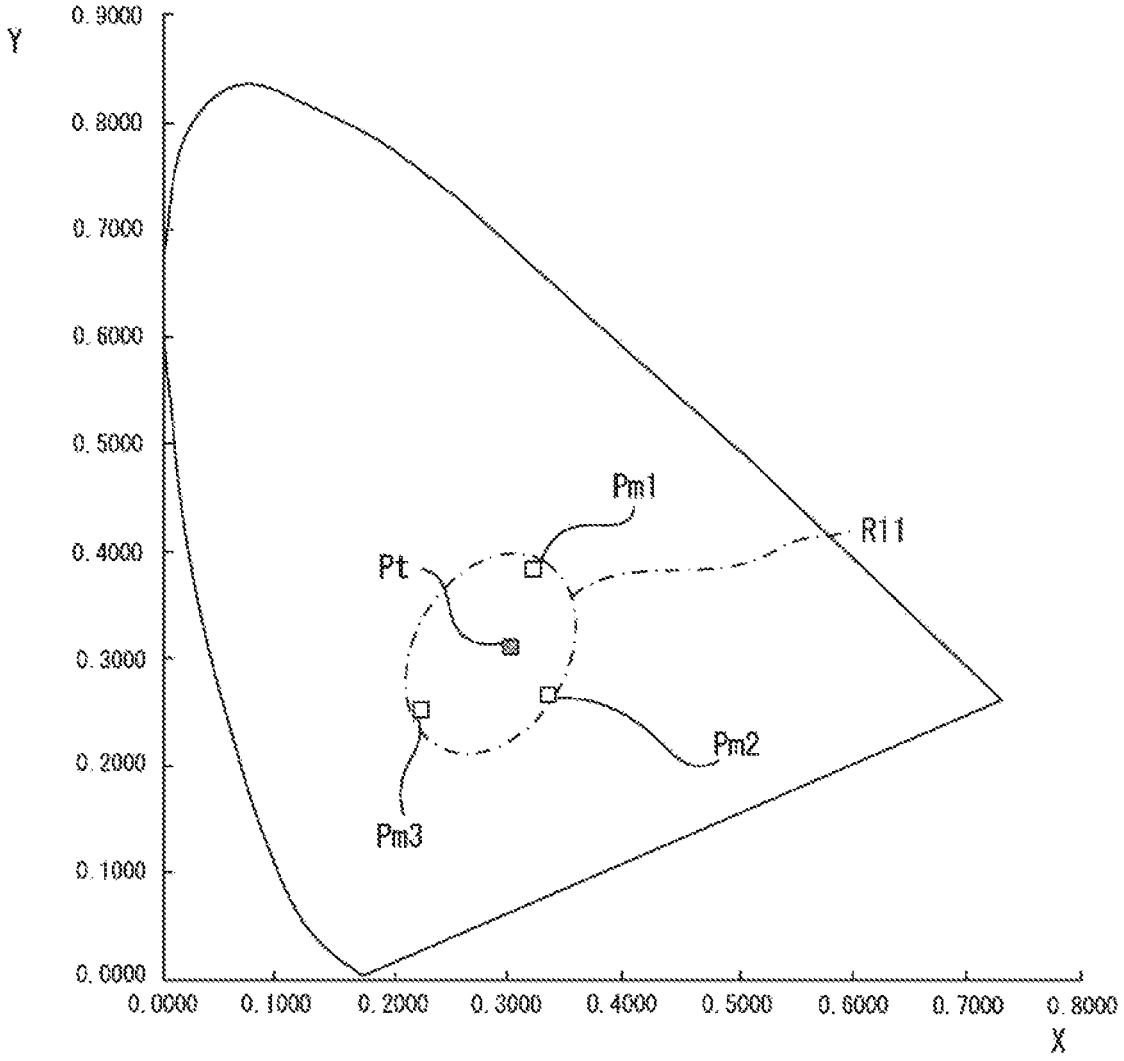
FIG. 3 is a chromaticity diagram showing a chromaticity variation correction method according to the present invention.

In FIG. 3, chromaticity coordinates Pm1 to Pm3 indicate results obtained by measuring the chromaticity of each of the LED units 21 with the chromaticity sensor and converting the measured chromaticity to chromaticity coordinates (x, y). As described above, when the same constant current value is supplied to the LEDs 211R, 211G, 211B and the same control signal is input to the LEDs 211R, 211G, 211B, all the full-color LED units 21 have the same chromaticity coordinate (white) Pt in design. However, luminous intensity and the wavelengths of the LEDs 211R, 211G, 211B have individual differences. Therefore, as shown in FIG. 3, when the constant current values of the constant current elements 212R, 212G, 212B are the same, the chromaticity coordinates Pm1 to Pm3 of the full-color LED units 21 vary over a wide range R11.

Figure 4:
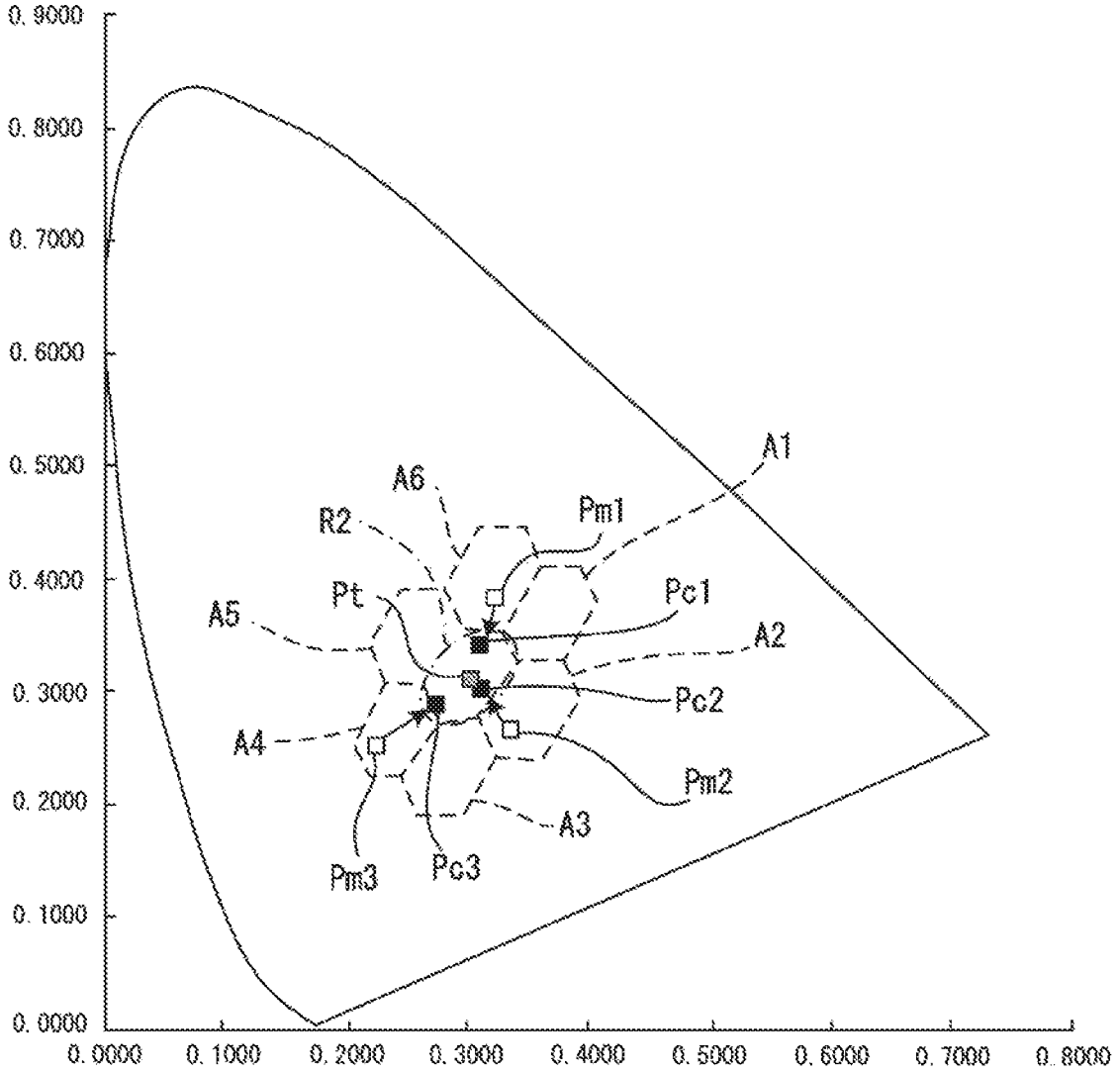
FIG. 4 is a chromaticity diagram showing the chromaticity variation correction method according to the present invention.

Therefore, as shown in FIG. 4, a plurality of correction areas A1 to A6 are provided in a chromaticity diagram, and a combination of current ratings (ratings of the constant current values) of the constant current elements 212R, 212G, 212B is changed according to the correction areas A1 to A6 to which the measured chromaticity coordinates Pm1 to Pm3 belong. In the present embodiment, the six correction areas A1 to A6 are set to surround the target chromaticity coordinate (white) Pt.

For example, if the chromaticity coordinates of the full-color LED unit 21 belong to the correction area A4 of the blue when the constant current values of the constant current elements 212R, 212G, 212B are a maximum of 20 mA, the full-color LED unit 21 is implemented such that the maximum constant current value of the constant current element 212R of the full-color LED unit 21 is 20 mA, the maximum constant current value of the constant current element 212G is 20 mA, and the maximum constant current value of the constant current element 212B is 15 mA.

Accordingly, by lowering a constant current flowing through the LED 211B, the luminous intensity of the blue LED 211B is decreased such that the full color LED unit 21 comes close to the target coordinate Pt. In FIG. 4, chromaticity coordinates Pc1 to Pc3 indicate the chromaticity coordinates of the respective full-color LED unit 21 after current rating (the constant current value) of the constant current element 212R has been adjusted. As shown in FIG. 4, variation in the chromaticity coordinates Pc1 to Pc3 of the full-color LED unit 21 can be contained in a narrow range R2.

According to the above-described embodiment the constant current values of the constant current elements 212R, 212G, 212B are set such that the plurality of full-color LED units 21 come closer to the target chromaticity coordinates Pt as compared with a case in which all the constant current elements 212R of all the full-color LED units 21 have the same constant current value. Accordingly, in at least one of the full-color LED units 21, at least one of the plurality of constant current elements 212R, 212G, 212B is set to a constant current value different from that of the other constant current elements 212R, 212G, 212B.

According to the above-described embodiment, the constant current values of the constant current elements 212R, 212G, 212B can be adjusted without adjusting the control signal to prevent the chromaticity variation of each of the hall color LED units 21. Accordingly, it is not necessary to change the software of the LED control unit 31 for each of the full-color LED units 21, so that it is possible to prevent the chromaticity variation of each of the full-color LED units 21 at low cost.

The present invention is not limited to the above-described embodiment and may be appropriately modified, improved, or the like. In addition, materials, shapes, sizes, numbers, arrangement positions, and the like of components in the above-described embodiment are optional and are not limited as long as the present invention can be achieved.

In the above-described embodiment, the full color LED 211 includes the LEDs 211R, 211G, 211B of three colors which are R, G, and B, but the present invention is not limited thereto. The emission color may be any color. For example, the full-color LED 211 may include LEDs of four colors which are R, G, B and W (white).

According to the above-described embodiment, at least one of the constant current values of the constant current elements 212R, 212G, 212B is set to a constant current value different from that of the other constant current elements 212R, 212G, 212B or all the full-color LED units 21, but the present invention is not limited thereto. In a state m which the constant current elements 212R, 212G, 212B in the plurality of full-color LED units 21 have the same current value and one of the full-color LED units 21 is already close to the target coordinate, the constant current elements 212R, 212G, 212B may be set to have the same constant current value for the full-color LED unit 21.

According to the above-described embodiment, the constant current elements 212R, 212G, 212B are set such that the full-color LED unit 21 comes close to the target coordinate Pt (white), but the present invention is not limited thereto. The constant current elements 212R, 212G, 212B may be set such that the plurality of full-color LED units 21 come close to the same chromaticity. For example, the constant current elements 212R, 212G, 212B may be set to have the same current value for one of the plurality of full-color LED units 21, and the constant current elements 212R, 212G, 212B of the remaining full-color LED units 21 may be set such that chromaticities of the remaining full-color LED units 21 approach a chromaticity of the one full-color LED unit 21.

Here, features of the light emitting apparatus and the chromaticity variation correction method according to the embodiment of the present invention are summarized briefly in the following [1] to [5], respectively.

[1] A light emitting, apparatus (2) including:

a plurality of light emitting units (21) including a light source (211) that includes a plurality of light emitters (211R, 211G, 211B) having different emission colors, constant current elements (212R, 212G, 212B) that are provided corresponding to the plurality of light emitters (211R, 211G, 211B) respectively and are configured to supply a constant current to the corresponding light emitters (211R, 211G, 211B) to cause the light emitters (211R, 211G, 211B) to emit light, in which, in at least one of the plurality of light emitting units (21), at least one of the plurality of constant current elements (212R, 212G, 212B) is set to a constant current value different from that of the other constant current elements (212R, 212G, 212B).

[2] The light emitting apparatus (2) according to [1], in which constant current values of the constant current elements (212R, 212G, 212B) are set such that the plurality of light emitting units (21) come closer to a same chromaticity as compared with a case in which all the constant current elements (212R, 212G, 212B) of all the light emitting units (21) have a same constant current value.

[3] The light emitting apparatus (2) according to [2], in which the plurality of light emitters (211R, 211G, 211B) emit red, blue, and green light, respectively, and in which the constant current values of the constant current elements (212R, 212G, 212B) are set such that the plurality of light emitting units (21) come close to white.

[4] A chromaticity variation correction method for correcting chromaticity variation of a plurality of light emitting units (21) each including a light source (211) that includes a plurality of light emitters (211R, 211G, 211B) having different emission colors, and constant current elements (212R, 212G, 212B) that are provided corresponding to the plurality of light emitters (211R, 211G, 211B) respectively and are configured to supply a constant current to the corresponding light emitters (211R, 211G, 211B) to cause the light emitters (211R, 211G, 211B) to emit light, the chromaticity variation correction method including:

adjusting constant current values of the constant current elements (212R, 212G, 212B) to correct chromaticity variation of the plurality of light emitting wins (21).

[5] The chromaticity variation correction method according to [4], further including:

setting all the constant current elements (212R, 212G, 212B) of all the light emitting units (21) to a same constant current value and measuring chromaticities of all the light emitting units (21) when a same control signal is supplied to all the light emitting units (21); and adjusting the constant current value of the constant current elements (212R, 212G, 212B) based on the measured chromaticities.

What is claims is:

1. A light emitting apparatus comprising:

a plurality of light emitting units including a light source that includes a plurality of light emitters having different emission colors, and constant current elements that are provided corresponding to the plurality of light emitters respectively and are configured to supply a constant current to the corresponding light emitters to cause the light emitters to emit light, wherein in at least one of the plurality of light emitting units, at least one of the plurality of constant current elements is set to a constant current value different from that of the other constant current elements, and wherein the light emitting apparatus is configured to implement:

setting all the constant current elements of all the light emitting units to a same constant current value and measuring chromaticities of all the light emitting units when a same control signal is supplied to all the light emitting units; and adjusting the constant current value of the constant current elements based on the measured chromaticities.

2. The light emitting apparatus according to claim 1, wherein constant current values of the constant current elements are set such that the plurality of light emitting units come closer to a same chromaticity as compared with a case in which all the constant current elements of all the light emitting units have the same constant current value.

3. The light emitting apparatus according to claim 2, wherein the plurality of light emitters emit red, blue, and green light, respectively, and wherein the constant current values of the constant current elements are set such that the plurality of light emitting units come close to white.

4. A chromaticity variation correction method for correcting chromaticity variation of a plurality of light emitting units each including a light source that includes a plurality of light emitters having different emission colors, and constant current elements that are provided corresponding to the plurality of light emitters respectively and supply a constant current to the corresponding light emitters to cause the light emitters to emit light, the chromaticity variation correction method comprising:

adjusting constant current values of the constant current elements to correct chromaticity variation of the plurality of light emitting units;

setting all the constant current elements of all the light emitting units to a same constant current value and measuring chromaticities of all the light emitting units when a same control signal is supplied to all the light emitting units; and adjusting the constant current value of the constant current elements based on the measured chromaticities.

* * * * *